US007207131B2

(12) United States Patent
Fitzpatrick

(10) Patent No.: US 7,207,131 B2
(45) Date of Patent: Apr. 24, 2007

(54) INTEGRAL MAGAZINE EXTRACTION EXTENSIONS

(76) Inventor: Richard Mark Fitzpatrick, 1109 Par Rd., Broomfield, CO (US) 80020

( * ) Notice: Subject to any disclaimer, the term of this patent is extended or adjusted under 35 U.S.C. 154(b) by 0 days.

(21) Appl. No.: 10/245,936

(22) Filed: Sep. 17, 2002

(65) Prior Publication Data

US 2003/0070341 A1 Apr. 17, 2003

Related U.S. Application Data

(62) Division of application No. 09/504,646, filed on Feb. 14, 2000, now Pat. No. 6,481,136.

(51) Int. Cl.
*F41A 9/65* (2006.01)

(52) U.S. Cl. ..... 42/50; 42/18

(58) Field of Classification Search ..... 16/409, 16/421, 419, 422; 42/90, 50, 49.01, 18, 22
See application file for complete search history.

(56) References Cited

U.S. PATENT DOCUMENTS

| | | | | |
|---|---|---|---|---|
| D33,384 | S | 10/1900 | Thorne | |
| 1,245,499 | A | 11/1917 | Orme | |
| 1,797,951 | A | 3/1931 | Gaidos | |
| 2,205,967 | A | 6/1940 | Wise | |
| 2,239,798 | A * | 4/1941 | Tinnerman | 16/422 |
| 2,609,898 | A * | 9/1952 | Finkelstein | 16/409 |
| 2,825,991 | A | 3/1958 | Stadelmann | |
| 4,364,150 | A * | 12/1982 | Remington | 16/409 |
| 4,442,962 | A | 4/1984 | Musgrave | |
| 4,799,306 | A * | 1/1989 | Collins et al. | 29/453 |
| 4,912,808 | A * | 4/1990 | Blakely | 16/422 |
| 5,566,487 | A | 10/1996 | Vaid | |
| 5,906,065 | A | 5/1999 | Pearce | |
| 6,212,815 | B1 | 4/2001 | Fitzpatrick | |

FOREIGN PATENT DOCUMENTS

| | | |
|---|---|---|
| GB | 3220 | 1/1908 |

* cited by examiner

*Primary Examiner*—Stephen M. Johnson
(74) *Attorney, Agent, or Firm*—Geoffrey E. Dobbin

(57) ABSTRACT

Integral extensions to aid in the extraction of ammunition magazines from ammunition pouches are provided by permanently attaching a handle to existing or modified floor plates. In one embodiment, a substitute floor plate is molded with a handle projecting from its outer face. In a second embodiment, a handle with a grip and a terminal end is provided with an attachment structure on the terminal end. Floor plates are then either modified by cutting anchoring holes to allow for the attachment of such handles without hindering use in an ammunition magazine or molded with said anchoring holes.

26 Claims, 2 Drawing Sheets

INTEGRAL MAGAZINE EXTRACTION EXTENSIONS

CROSS REFERENCES TO RELATED APPLICATIONS

This application is a divisional application of application Ser. No. 09/504,646, filed on Feb. 14, 2000, now U.S. Pat. 6,481,136.

FIELD OF INVENTION

The present invention relates to the fashioning of extensions on ammunition magazines and more particularly to loop handle extensions that are positioned on the floor end of ammunition magazines by either replacing the floor plate, modifying the floor plate or extending the side magazine walls in order to aid with both the extraction of said ammunition magazine from ammunition pouches and the insertion into a weapon.

BACKGROUND OF THE INVENTION

The use of loops to aid in the removal of ammunition magazines from a storage compartment is known in the prior art. Likewise, the use of handle attachments or tabs or other extensions to carry ammunition magazines and other objects is also known. These attachments and modifications, while suitable for their individual purposes, are not as suitable for the purpose of this invention, namely providing an extension that is of one piece with an ammunition magazine or with the floor plate of said magazine for the purpose of extraction of said magazine from ammunition pouches worn on the user. For example, the current practice of forming duct tape tabs and cord loops on ammunition magazines; U.S. Pat. No. 6,212,815 to Fitzpatrick; U.S. Pat. No. 5,906,065 to Pearce; U.S. Pat. No. 4,442,962 to Musgrave; U.S. Pat. No. 2,825,991 to Stadelmann; U.S. Pat. No., 2,205,967 to Wise; U.S. Pat. No. 1,797,951 to Gaidos; U.S. Pat. No. 1,245,499 to Orme And U.S. Pat. No. D-33,384 to Thorn are all illustrative of the prior art.

Currently, in the field, soldiers use either loops of parachute cord attached to ammunition magazines by duct tape or they form tabs by folding duct tape over the butt end of their ammunition magazines. The loops and tabs aid soldiers in the extraction of said magazines from ammunition pouches carried on the user. However, the duct tape tends to wear and often needs replaced. The duct tape also leaves a sticky residue when removed and provides no other benefit other than the increased friction or fastening a pull loop to the ammunition magazine. Soldiers have also extracted the inside portion of a length of parachute cord, leaving the casing, tied said casing together and positioned the formed loop so that it encircles the floor plate of an ammunition magazine before they replaced said floor plate, with the loop, in the magazine. Thus they have formed a loop, extending from the bottom of the magazine. Unlike the "para-cord loops" the handle according to this invention does not move relative to the magazine, allowing for the entire range of benefits of use of the handles with a lower cost than other handle embodiments.

While the aforementioned inventions and modifications accomplish their individual objectives, they do not describe an integral extension that is used primarily for the extraction of ammunition magazines from ammunition pouches, as evidenced by the duct tape modifications used in the field.

Handle and loop attachments used in the prior art are mainly used for affixing an ammunition magazine to other objects, such as clothing or vehicles. In one of the two cases where handle attachments are used for extraction, the handle is a simple metal wire forming a loop and is not adapted for use in the various positions a user may wear an ammunition pouch. There are also disadvantages with the duct tape modifications, particularly regarding removal and in the amount of slack in a loop of parachute cord. While the Pearce '065 patent discloses replacement of the floor plate, the enhancer is designed for improving the grip a user has on his gun, not the ammunition magazine, and does not disclose any type of handle extension. The Fitzpatrick '815 patent discloses a handle that is attached to an external sleeve, not an integral handle. In this respect, the extensions according to the present invention depart substantially from the usual designs in the prior art. In doing so, this invention provides integral extensions that are primarily designed for the purpose of aiding the extraction of ammunition magazines from pouches worn on the user.

SUMMARY OF THE INVENTION

In view of the foregoing disadvantages inherent in the known types of attachments and grip extensions, this invention provides extensions for use on the base of ammunition magazines. As such, the present invention's general purpose is to provide a new and improved integral extensions that will aid in the extraction of ammunition magazines from pouches worn on the user.

To attain this purpose, the invention has three individual embodiments. The first embodiment essentially comprises a replacement floor plate, typically molded of a hard plastic or metal, with a tab or loop extending from the replacement floor plate, typically molded from a more resilient plastic or thermoplastic compound. The product would be manufactured by using a bifurcated molding process where the floor plate portion would be molded first and the extension would be molded onto the floor plate in a second molding step. Alternatively, the floor plate may be molded or fashioned with at least one anchoring hole and the handle then either injection molded onto the floor plate or pre-molded with at least one anchoring means and mechanically coupled to the floor plate. The second embodiment would require retrofitting all existing floor plates with at least one anchoring hole along the center of their elongated sides or boring a plurality of holes through a floor plate and either injection molding or mechanically coupling a handle onto the floor plate. In the third embodiment, a plastic magazine would be molded with a resilient loop or tab on its base end or a handle may be attached to the base end by mechanical, ultrasonic welding, or adhesive means. This application will focus primarily on replacement floor plates with loop-type handles extending therefrom. A loop-type handle would be a handle that when attached to the floor plate would be circuitous, i.e. together they form a short cylindrical shape. This would be distinguished from a tab-type handle, which merely extends outwardly from the floor plate.

These designs have numerous advantages over the prior art. First, the extensions are integral with the magazine and have a lower incidence of grip failure. Second, the instant embodiment is easily replaceable if and when necessary. Third, the standard means of ejection causes the butt end of the magazine to impact the ground. The molded handle portion acts as a shock absorber for the magazine when it is ejected from the rifle and reduces impact damage to the magazine. Fourth, the extensions abut against the lid of the pouch. This abutment effectively anchors the magazine against the pouch lid and reduces noise caused by the rattling of magazines against pouch when the user is moving. Also, different shapes and sizes of handles may be used to obtain maximum benefit for users with specialized uses (e.g. shorter, non-looped handles for those using the invention in heavy brush situations, used of gloves, location of pouch/holder on user, etc.).

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide integral extensions for use on ammunition magazines to aid in their extraction from ammunition pouches.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
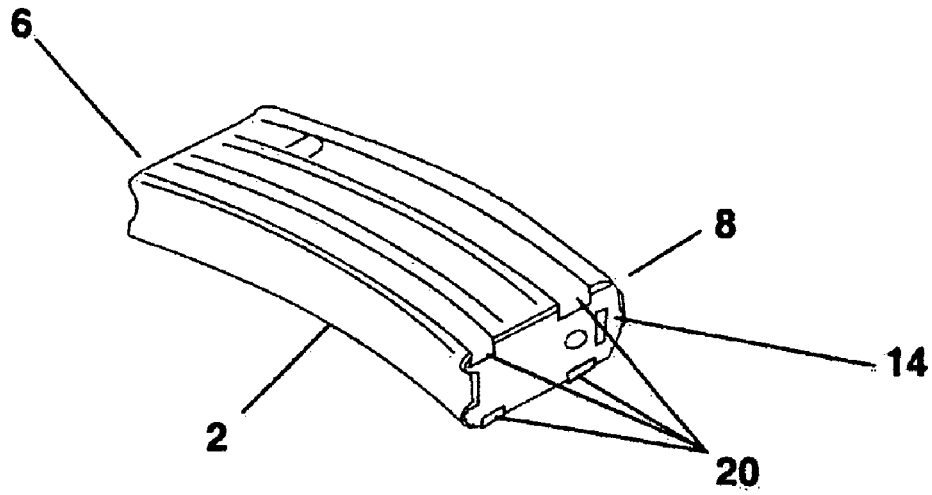
FIG. 1 is a perspective view of a standard M-16 magazine.
Figure 2:
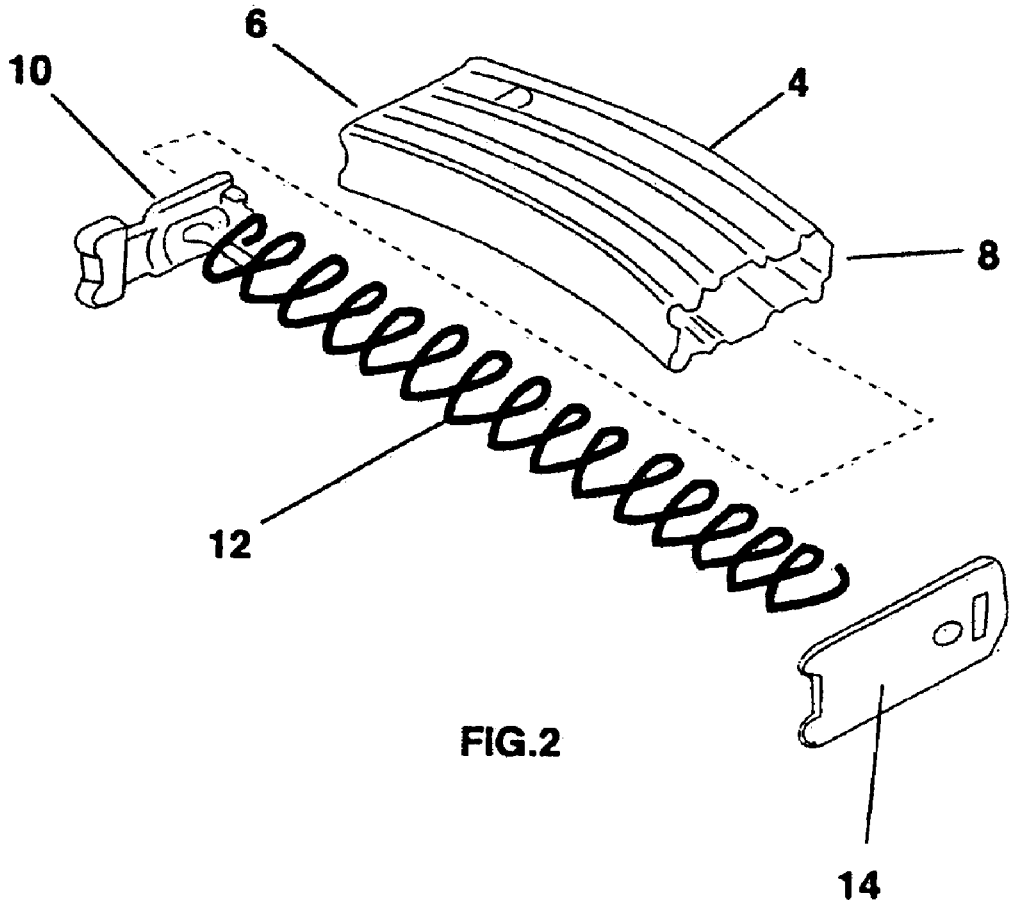
FIG. 2 is an exploded view of the magazine in FIG. 1.
Figure 4:
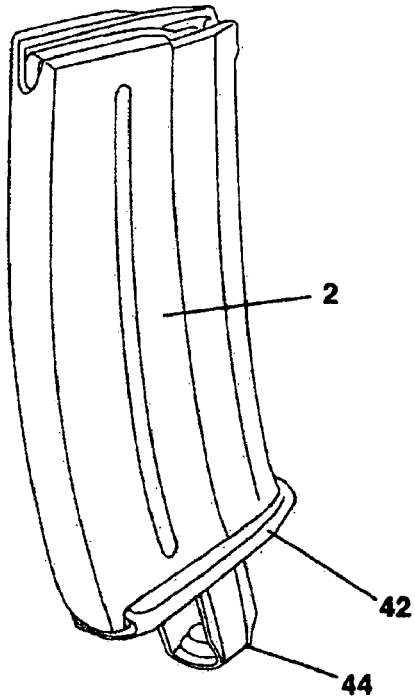
FIG. 4 is a perspective view of a magazine with a sliding type floor plate with the invention installed.
Figure 5:
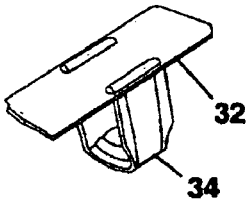
FIG. 5 is a perspective view, as seen from the bottom, of the invention as a standard replacement floor plate with a loop design.

With reference now to the drawings, the preferred embodiment of the new and improved integral extensions for ammunition magazines embodying the principles and concepts of the present invention will be described. Specifically, it will be noted in the figures, especially FIGS. 5, 6, and 7, that the invention relates to the addition of extensions to the floor plate of ammunition magazines. Before the invention can be explained, a brief description of the structure of an ammunition magazine, shown in FIGS. 1 and 2, is necessary. The generic magazine 2 is a relatively simple structure. The outer casing 4 is suitably sized and shaped to receive ammunition. The casing 4 has a feed end 6 and a floor, or butt, end 8. The feed end 6 is designed to engage the weapon. Inside the casing, a follower plate 10 is in contact with the follower spring 12, which is in turn, in contact with the floor plate 14. Floor plate 14 is designed to associate with the outer casing 4 of the magazine 2 at its floor end 6 and its individual design will vary with the type of magazine. FIGS. 1 and 2 depict a standard magazine utilizing a tab structure 20 to hold floor plate 14 in place. FIG. 4 depicts a sliding floor plate design. In either design, floor plate 14 is designed to interface with the magazine 2 and substitute floor plates must be similarly designed. When ammunition is loaded into the feed end 6, the follower plate 10 compresses the follower spring 12 against the floor plate 14. This compression is relaxed when a round of ammunition is loaded into the weapon's firing chamber and the spring 12 therefore raises the follower plate 10, and associated ammunition relative to the magazine 2 and weapon. The raising readies the next round of ammunition for loading into the weapon's firing chamber after the first round is used and expelled.

Figure 3:
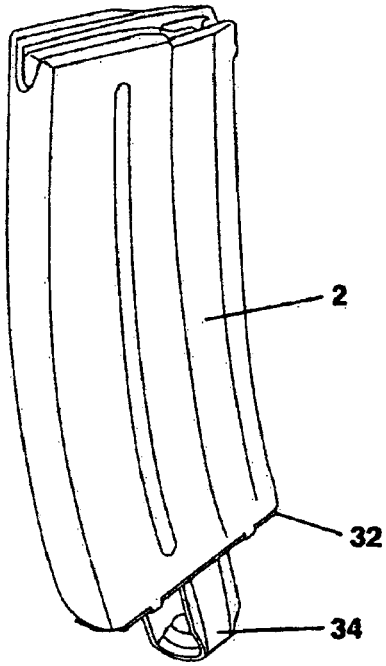
FIG. 3 is a perspective view of the magazine of FIG. 1 with the invention installed.
Figure 6:
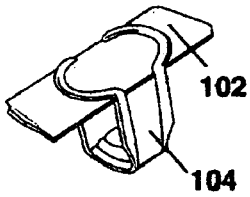
FIG. 6 is a perspective view, as seen from the bottom, of the invention as a retrofitted floor plate with a loop design.

The preferred embodiment of the invention, shown in FIGS. 3 and 4, is a substitute floor plate 32, 42 positioned on the floor end of an ammunition magazine. The floor plate 32, 42 is ideally molded from a rigid plastic or metal, with a handle 34, 44 protruding from said substitute floor plate 32, 42. The handle 34, 44 can be molded onto the substitute floor plate 32, 42 by using a bifurcated molding process where the floor plate 32, 42 is molded from a rigid plastic and the handle 34, 44 is ideally molded from a softer, more resilient material, such as thermoplastic, and attached to the substitute floor plate 32, 42. The two staged molding process may include either molding the handle 34, 44 directly onto the floor plate 32, 42, so that the handle 34, 44 and floor plate 32, 42 are of one piece, or molding the floor plate 32, 42 with a plurality of holes and then the handle 34, 44 may be injection molded, onto the floor plate 32, 42, shown in FIGS. 5 and 7. Alternatively, The handle 34, 44 may be molded separately, shown in FIGS. 8, 9 and 10, having a grip end 31, 41 and a fastening end 33, 43. The fastening end should have at least one terminus 35, 45, each with at least one anchoring means, such as the anchoring nodes 38, 48 shown in FIGS. 10 and 12, and then mechanically coupled to the floor plate 32, 42. The handle may take any shape, such as a loop 34 as shown in FIG. 6. The shape of the handle is variable, depending on the user's preferences and the design of the magazine.

Figure 8:
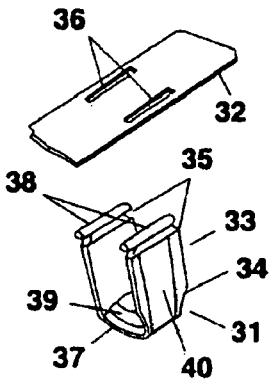
FIG. 8 is an exploded view of the invention as seen in FIG. 6.

Either handle 34 should extend approximately 1.0 to 1.5 inches from the substitute floor plate 32. This will enable the handle 34, 94 to engage the lid of an ammunition pouch. With the loop handle version, the loop 34 is thicker at its apex 37 so as to better withstand the stress of pulling the invention and the magazine out of the ammunition pouch by the loop 34. The width of loop 34 at apex 37 is less than the rest of loop 34 so that a user's finger may curl around loop 34. For ease of fabrication and to increase friction between a finger and the loop 34, the underside of the apex 37 may be molded in a step-like pattern 39, as shown in FIG. 8. A roughened recessed area 40 should also be provided. The recessed area 40 extends along the length of loop 34.

Figure 7:
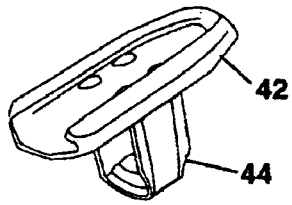
FIG. 7 is a perspective view, as seen from the bottom, of the invention as a sliding replacement floor plate with a loop design.
Figure 9:
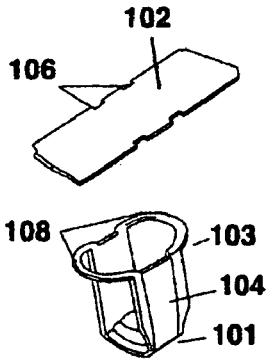
FIG. 9 is an exploded view of the invention as seen in FIG. 7.
Figure 10:
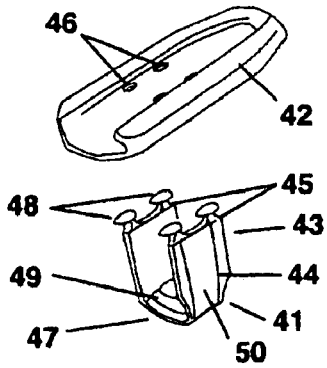
FIG. 10 is an exploded view of the invention as seen in FIG. 8.

In the second, retrofitting, embodiment, which FIGS. 5–10 may represent the floor plate 32 is modified to accommodate the attachment of a handle 34. Small holes 36, similar to those molded into the substitute floor plate 32 of the previous embodiment, as shown in FIG. 8, may be bored into a floor plate 32and a handle 34 either injection molded or mechanically coupled onto the modified floor plate as in the previous embodiment. The number of holes 46 and nodes 48 may vary, as shown in FIGS. 7 and 10. A specific variation, as shown in FIGS. 6 and 9, holes 106 may be positioned along the sides of the floor plate 102, thus forming notches along the floor plate's elongated ends and a handle 104 having a grip end 101 and a fastening end 103 is fastened to the floor plate 102. An attachment means 108 is located at the handle's fastening end 103 fits around the floor plate 102 at the notches 106. The attachment means 108 may either be a continuous bracing loop, a plurality of tabs or a plurality of continuous bracing loops, as shown in FIG. 9, that are threaded around the notches 106. The attachment means in either variation may be affixed to the floor plate 102 with some type of adhesive, such as epoxy or glue, or ultrasonically welded, assuming the floor plate 102 and handle 104 are plastic. The attachment structure should be thin enough to not interfere with the normal operation of the ammunition magazine, that is to say not interfere with the follower spring 12 of FIG. 2, but thick enough to withstand repeated use, usually ¼ inch to ¾ *inch*.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A handle extension for ammunition magazines comprising:

a. a floor plate, having at least one planar side being designated as the obverse side with an opposite side being designated as the reverse side;

b. a handle, of one piece with the floor plate, protruding between 1.0 and 1.5 inches from the obverse side of the floor plate, an end of the handle furthest from the floor plate defined as the apex of the handle;

wherein the handle bridges from a first position on the floor plate to a second position on the floor plate while maintaining no contact with the floor plate other than at said first and second positions.

2. The handle extension of claim 1, the handle further comprising at least one recessed area, fashioned along the handle, said recessed area defining an interior region.

3. The handle extension of claim 2, wherein any interior regions of the at least one recessed area are roughened to increase friction for grasping said handle extension.

4. The handle extension of claim 3, wherein the apex of the handle is molded with greater thickness with respect to the rest of the handle.

5. The handle extension of claim 4, the apex further comprising an exposed series of generally parallel surfaces, each at a different relative level to any surfaces immediately adjacent to a given surface in the series, said series positioned on an underside of the apex, towards the floor plate.

6. The handle extension of claim 4, the apex of the handle being roughened to increase friction for grasping said handle extension.

7. The handle extension of claim 2, wherein the apex of the handle is molded with greater thickness with respect to the rest of the handle.

8. The handle extension of claim 7, the apex further comprising an exposed series of generally parallel surfaces, each at a different relative level to any surfaces immediately adjacent to a given surface in the series, said series positioned on an underside of the apex, towards the floor plate.

9. The handle extension of claim 7, the apex of the handle being roughened to increase friction for grasping said handle extension.

10. The handle extension of claim 1, wherein the apex of the handle is molded with greater thickness with respect to the rest of the handle.

11. The handle extension of claim 10, the apex further comprising an exposed series of generally parallel surfaces, each at a different relative level to any surfaces immediately adjacent to a given surface in the series, said series positioned on an underside of the apex, towards the floor plate.

12. The handle extension of claim 10, the apex of the handle being roughened to increase friction for grasping said handle extension.

13. The handle extension of claim 1, the first and second positions being proximate each other and the handle forming an aperture.

14. A handle extension for ammunition magazines comprising:

a. a handle, of one piece, having an extraction end and a fastening end, the fastening end further comprising at least one anchoring node likewise of one piece with the handle, the furthest extremity of the extraction end being designated as the apex of the handle;

b. a substitute floor plate, having two planar sides, one designated as the obverse side with the other being designated as the reverse side and further comprising at least one anchoring hole, the number of the at least one anchoring hole corresponding to the number of at least one anchoring node and said at least one anchoring hole positioned and sized on the substitute floor plate in a manner to receive the at least one anchoring node;

wherein the handle and floor plate are permanently coupled by the at least one anchoring node being forced through the at least one hole on the floor plate from the obverse side and being secured on the reverse side of the floor plate such that the handle bridges from a first position on the floor plate to a second position on the floor plate while maintaining no contact with the floor plate other than at said first and second positions while protruding from the obverse side of the substitute floor plate between 1.0 and 1.5 inches.

15. The handle extension of claim 14, the handle further comprising at least one recessed area, fashioned along the handle, said recessed area defining an interior region.

16. The handle extension of claim 15, wherein any interior regions of the at least one recessed area are roughened to increase friction for grasping said handle extension.

17. The handle extension of claim 16, wherein the apex of the handle is molded with greater thickness with respect to the rest of the handle.

18. The handle extension of claim 17, the apex farther comprising an exposed series of generally parallel surfaces, each at a different relative level to any surfaces immediately adjacent to a given surface in the series, said series positioned on an underside of the apex, towards the floor plate.

19. The handle extension of claim 17, the apex of the handle being roughened to increase friction for grasping said handle extension.

20. The handle extension of claim 15, wherein the apex of the handle is molded with greater thickness with respect to the rest of the handle.

21. The handle extension of claim 20, the apex further comprising an exposed series of generally parallel surfaces, each at a different relative level to any surfaces immediately adjacent to a given surface in the series, said series positioned on an underside of the apex, towards the floor plate.

22. The handle extension of claim 20, the apex of the handle being roughened to increase friction for grasping said handle extension.

23. The handle extension of claim 14, wherein the apex of the handle is molded with greater thickness with respect to the rest of the handle.

24. The handle extension of claim 23, the apex farther comprising an exposed series of generally parallel surfaces, each at a different relative level to any surfaces immediately adjacent to a given surface in the series, said series positioned on an underside of the apex, towards the floor plate.

25. The handle extension of claim 23, the apex of the handle being roughened to increase friction for grasping said handle extension.

26. The handle extension of claim 14, the first and second positions being proximate each other and the handle forming an aperture.

* * * * *